US010568431B2

(12) United States Patent
Risdall et al.

(10) Patent No.: US 10,568,431 B2
(45) **Date of Patent: *Feb. 25, 2020**

(54) SEATING SYSTEM

(71) Applicant: SMITH SYSTEM MANUFACTURING COMPANY INC., Plano, TX (US)

(72) Inventors: Charles Risdall, Plano, TX (US); Michael Risdall, Plano, TX (US); Charles A. Patterson, Durango, CO (US); Joe Ricchio, Long Beach, CA (US)

(73) Assignee: Smith System Manufacturing Company Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/289,012

(22) Filed: Feb. 28, 2019

(65) Prior Publication Data

US 2019/0191881 A1 Jun. 27, 2019

Related U.S. Application Data

(63) Continuation of application No. 15/422,199, filed on Feb. 1, 2017, now Pat. No. 10,258,160.

(51) Int. Cl.

| | |
|---|---|
| ***A47C 3/04*** | (2006.01) |
| ***A47D 1/00*** | (2006.01) |
| ***A47C 3/38*** | (2006.01) |

(52) U.S. Cl.

CPC ..... *A47C 3/04* (2013.01); *A47C 3/38* (2013.01); *A47D 1/004* (2013.01)

(58) Field of Classification Search

CPC ..... A47C 3/04; A47B 3/063; A47B 11/00; A47B 49/00; A47B 2200/02; A47B 87/0207; B65D 2519/00935

USPC ..... 108/91, 94, 92, 53.1

See application file for complete search history.

(56) References Cited

U.S. PATENT DOCUMENTS

| | | | |
|---|---|---|---|
| 2,552,693 | A | 5/1951 | Smith |
| 2,560,785 | A | 7/1951 | Wilson |
| 2,623,633 | A | 12/1952 | Bladow |
| 2,933,850 | A | 4/1960 | Manatt |
| 3,536,359 | A | 10/1970 | Amos |
| 3,552,548 | A | 1/1971 | Wallestad et al. |
| 3,558,186 | A | 1/1971 | Shore et al. |
| 3,683,821 | A | 8/1972 | Mangold |
| 3,719,272 | A | 3/1973 | Bodine et al. |
| 3,719,273 | A | 3/1973 | Abe |
| 3,995,749 | A | 12/1976 | Haskins |
| 4,664,260 | A | 5/1987 | Stokes |
| 5,332,099 | A | 7/1994 | Thornberg |
| 5,558,417 | A | 9/1996 | Termotto |
| 6,478,374 | B1 | 11/2002 | Sinoway |
| D485,746 | S | 1/2004 | Abraham et al. |
| 6,811,125 | B1 | 11/2004 | Koefelda et al. |
| 6,834,916 | B2 | 12/2004 | Volkman et al. |
| 7,261,377 | B2 | 8/2007 | Ehud |

(Continued)

FOREIGN PATENT DOCUMENTS

| | | | |
|---|---|---|---|
| EP | 1334675 | A2 | 8/2003 |
| JP | 10229952 | A | 2/1998 |

*Primary Examiner* — Jose V Chen

(74) *Attorney, Agent, or Firm* — Winthrop & Weinstine, P.A.; Nadeem W. Schwen

(57) ABSTRACT

A seating system configured for providing multi-directional motion.

17 Claims, 15 Drawing Sheets

(56) References Cited

U.S. PATENT DOCUMENTS

| | | | | |
|---|---|---|---|---|
| 7,478,878 | B2 | 1/2009 | Oettinger | |
| 7,799,482 | B2 | 9/2010 | Cho et al. | |
| 8,317,150 | B2 | 11/2012 | Baechle | |
| 8,764,116 | B2 | 7/2014 | Weber et al. | |
| 8,998,319 | B2 | 4/2015 | Bahnerman et al. | |
| 9,010,867 | B2 | 4/2015 | Martin et al. | |
| 9,072,384 | B2 | 7/2015 | Saint Pierre et al. | |
| 9,392,872 | B2 | 7/2016 | Saint Pierre et al. | |
| D803,604 | S | 11/2017 | Arditi | |
| 10,258,160 | B2 * | 4/2019 | Risdall | A47C 3/04 |

* cited by examiner

SEATING SYSTEM

CROSS-REFERENCE TO RELATED APPLICATIONS

This application is a continuation of U.S. patent application Ser. No. 15/422,199 filed Feb. 1, 2017, which is herein incorporated by reference in its entirety.

STATEMENT REGARDING FEDERALLY SPONSORED RESEARCH OR DEVELOPMENT

Not applicable.

TECHNICAL FIELD

The instant disclosure relates to a seating system and a method of assembling the seating system.

BACKGROUND

U.S. Pat. Nos. 9,072,384 and 9,392,872 disclose a chair that allows small, subtle multi-directional motion by the user while maintaining the functionality and space requirements of a stack chair. The multi-directional motion is facilitated by flexible supports mounted to the frame of the chair which suspend and support the chair's seat. A range of motion in the seat is thereby provided which is limited by an integrated stopping mechanism built into the chair's frame. Allowing the user to change seating attitude with concomitant motion of the chair seat improves user comfort and prevents or delays user fatigue during long seating sessions while maximizing efficiency of work accomplished during a seating session.

U.S. Pat. No. 9,010,867 discloses an article of furniture comprising a stool configured to be used on a generally horizontal surface such as a floor. The stool comprises a seat and a base comprising a rounded bottom surface configured to rest upon the floor. A mass is positioned beneath the seat so that the base is at equilibrium in a first tilted orientation relative to the floor. The base can be tilted to second tilted orientation relative to the floor by tilting the rounded bottom surface of the base relative to the floor.

U.S. Pat. No. 8,998,319 discloses a seating device including a seat, a post positioned below and attached to the seat, a base positioned below and attached to the post, an inflatable bladder positioned below and attached to the base, and a guard positioned below and attached to the base. The inflatable bladder comprises a portion of a sphere, the portion comprising less than 35 percent of the sphere. The inflatable bladder covers over 35 percent of an underside of the base, and the guard comprises a solid circular piece extending downward from the base with a bottom edge located above a bottom of the inflatable bladder when the inflatable bladder is fully inflated.

U.S. Pat. No. 8,764,116 discloses an item of seating furniture containing a seat providing a seat surface, a generally circular foot panel positioning the item of seating furniture on a floor, and a central part, which connects the seat to the foot panel and of which a vertical center axis runs centrally through the foot panel. The foot panel is of at least partially convex configuration and that side of the foot panel which is directed toward the floor is configured, at least in part, as a non-slip surface. This creates an ergonomic item of seating furniture which stands in a stable state.

U.S. Pat. No. 7,478,878 discloses a self-righting chair having: (i) a seat; (ii) a base member; and (iii) a connector connecting the base member to the seat, wherein the base member has a curved configuration, and wherein the base member has sufficient weight, such that when a force is exerted to move the chair from a substantially vertical position to a tilted position, the chair is moved from the substantially vertical position to the tilted position, then returns to the substantially vertical position when the tilting force is removed.

U.S. Pat. No. 6,834,916 discloses a gardening stool that allows for tilting and pivoting. The gardening stool has an elongated base connected to a seat by a post. The elongated base is convex and is tapered towards the front for pivoting. The base may include a flattened region located toward the rear of the post for stability. The base may further include compartments for holding tools.

U.S. Pat. No. 3,558,186 discloses a child's high chair consisting of a plurality of hollow cylinders of successively smaller diameter, a chair, and a feeding tray. The cylinders being adapted to be stacked, one upon the other, and secured together, to form a high base for the chair and the feeding tray mounted thereon. When disassembled, the several components being nestable, one within the other, to form a compact carrying package of which the feeding tray forms the cover.

U.S. Pat. No. 2,560,785 discloses a hassock or the like comprising a plurality of separate structural units assembled in a plurality of side-by-side stacks, a pair of cover members extending across opposite ends of the stacks, and tie members fastened to the cover members and extending through the units in the stacks, whereby the units are held together by the tie members and cover members to form a unitary frame.

European Patent No. EP 1334675 discloses a stool having a base provided with a convex lower surface and a soft skirting, a central column which can be fitted with a height adjusting mechanism, and a seat facilitating a squatting position. The outer contours of the seat are curved, resulting in three sections shaped like a bicycle seat, allowing the child to sit in a stable position with the knees slightly apart and the pubic bone supported by the projecting section. The stool can be tilted because of the convex center of the base and the surrounding soft skirting which also protects the child from injury when his/her fingers get caught under the base.

Japanese Patent No. JP 10-229952 discloses a bath stool having of a top seating part, the lowest leg part, and a plurality of mutually stackable sections arranged in-between. The number of sections to use is determined depending on child's height when sitting, with the stool height adjusted by stacking the seating part, leg part and in-between sections like picnic boxes. Thus, when a parent and a child take a bath together, the child can sit on the stool with the head above the water level in the bathtub, thereby enabling them to enjoy taking a bath stably and leisurely.

SUMMARY

A non-limiting exemplary embodiment of a seating system includes a pedestal and a reversible base. The pedestal includes a top having an outer surface and a perimetrical wall extending away from the top. The reversible base includes spaced apart inner and outer surfaces, a wall extend between the spaced apart inner and outer surfaces, and a ledge extending outwardly from the inner surface. A bottom of the perimetrical wall of the pedestal and the ledge of the reversible base include a locking mechanism configured for removably and reversibly securing the pedestal and the reversible base to each other. The top of each pedestal and the bottom of the perimetrical wall of each pedestal are configured for removably securing two pedestals to each other. In some embodiments, the pedestal and the reversible base are removably secured to each other with an outer surface of the reversible base oriented either outwardly and away from the pedestal or inwardly into a hollow of the pedestal. In certain embodiments, the outer surface of the reversible base is convex. In some embodiments, the top of the pedestal is configured for seating.

A non-limiting exemplary embodiment of a method of assembling a seating system includes providing a pedestal and a reversible base and removably and reversibly securing the pedestal and the reversible base to each other. In some embodiments, a height of the seating system is adjusted by stacking two pedestals, one atop another, and removably securing them to each other.

DETAILED DESCRIPTION

One or more non-limiting exemplary embodiments are described herein with reference to the accompanying drawings, wherein like elements are designated by like numerals. It should be clearly understood that there is no intent, implied or otherwise, to limit the disclosure to the illustrated and described embodiments. While multiple non-limiting exemplary embodiments are provided, variations thereof will become apparent or obvious. Accordingly, any and all variants for providing functionalities similar to those of the illustrated and described embodiments are considered as being within the metes and bounds of the instant disclosure.

Figure 1:
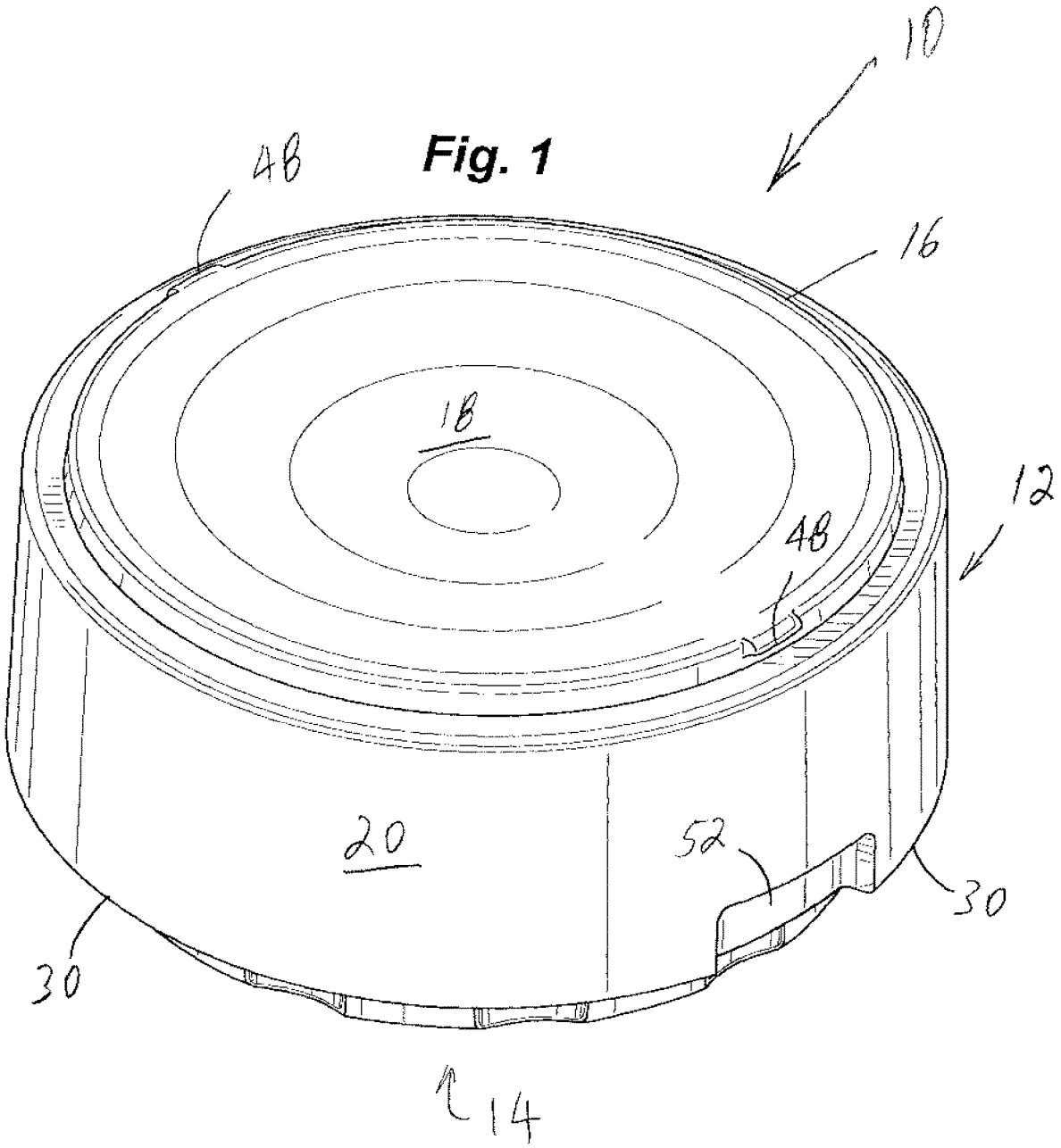
FIG. 1 is a top perspective view of a non-limiting exemplary embodiment of a seating system.
Figure 2:
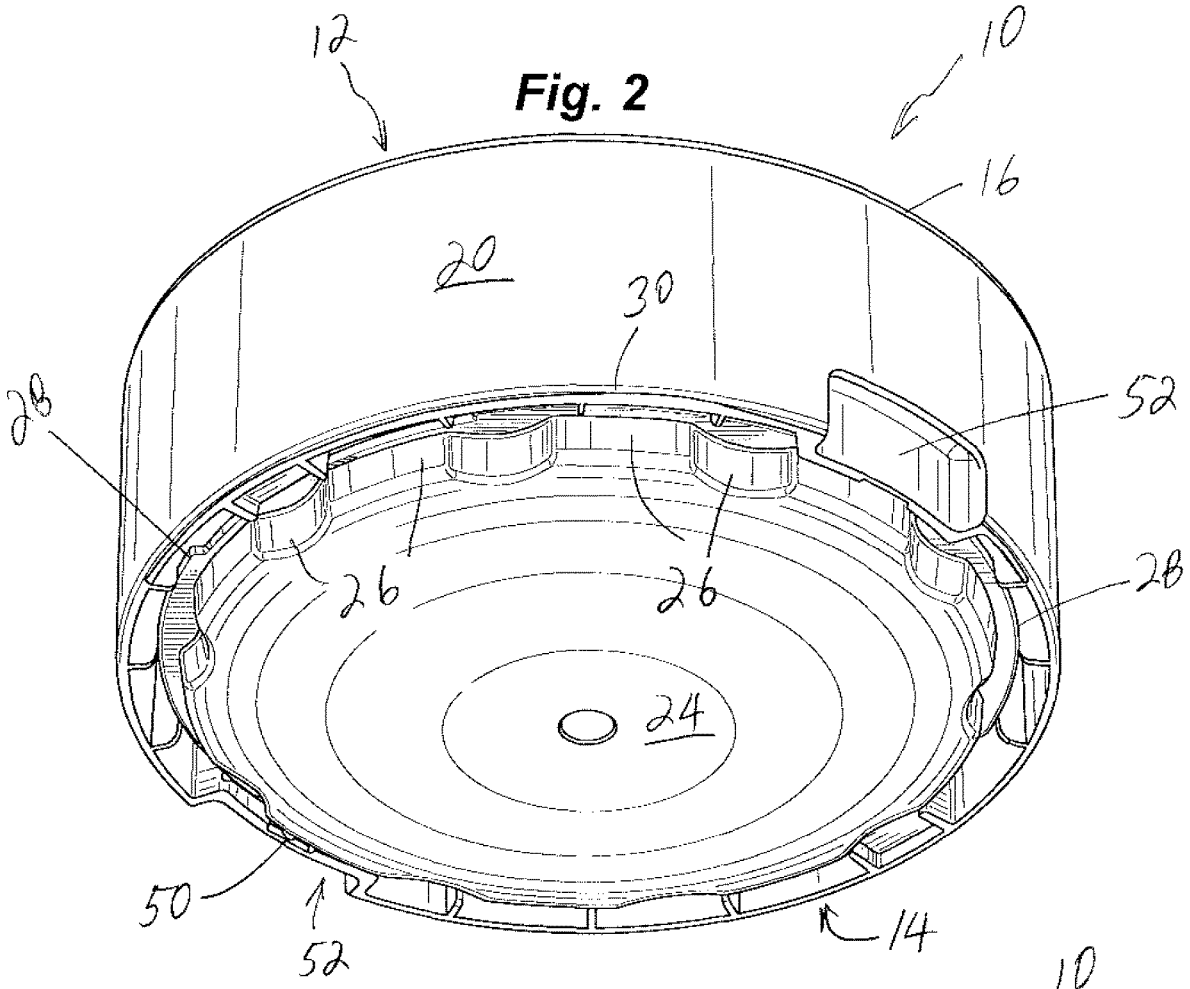
FIG. 2 is a bottom perspective view of the seating system of FIG. 1.
Figure 3:
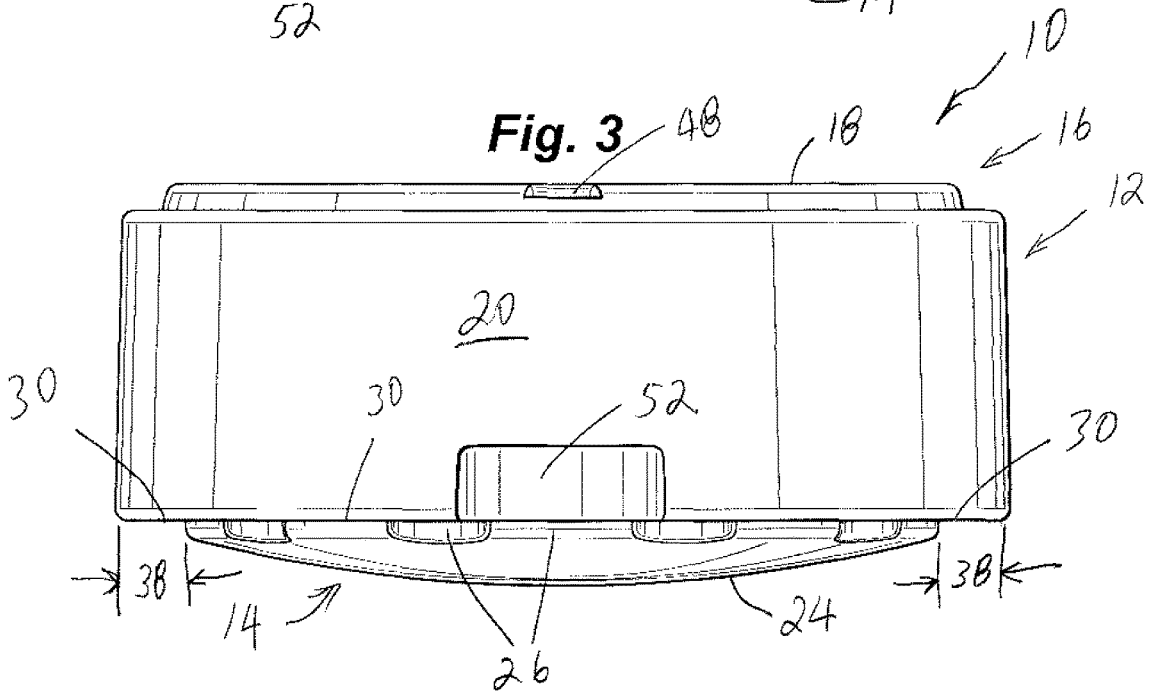
FIG. 3 is a side view of the seating system of FIG. 1.
Figure 4:
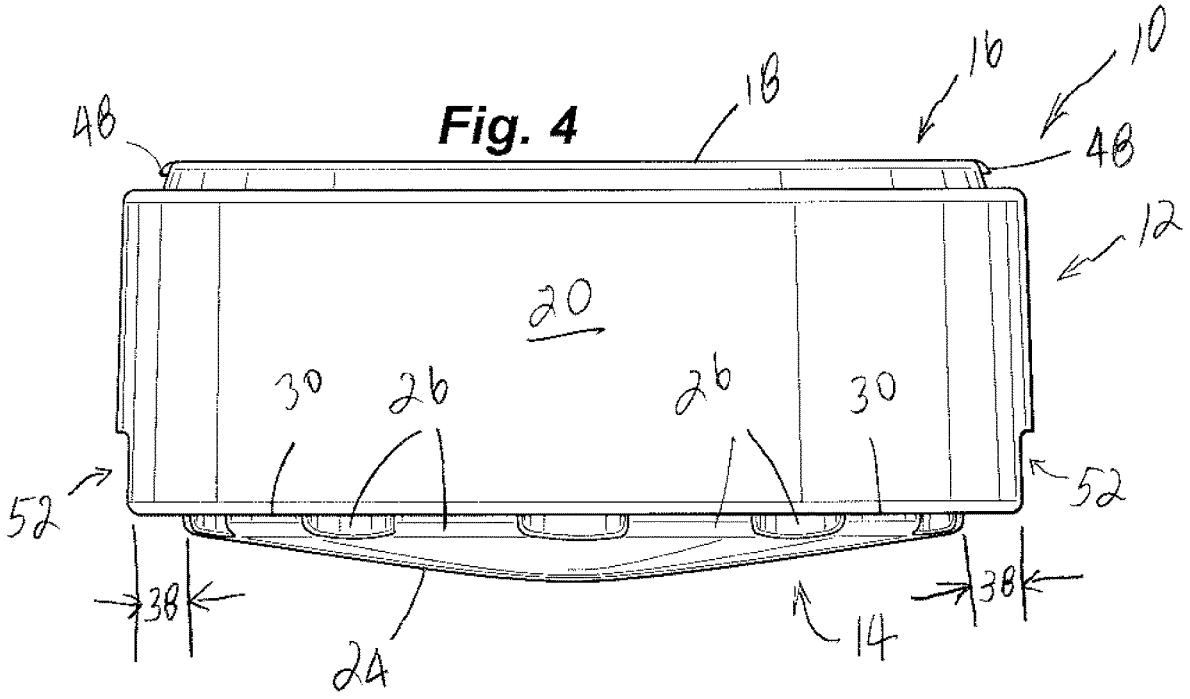
FIG. 4 is a side view orthogonal to the side view of FIG. 3.
Figure 5:
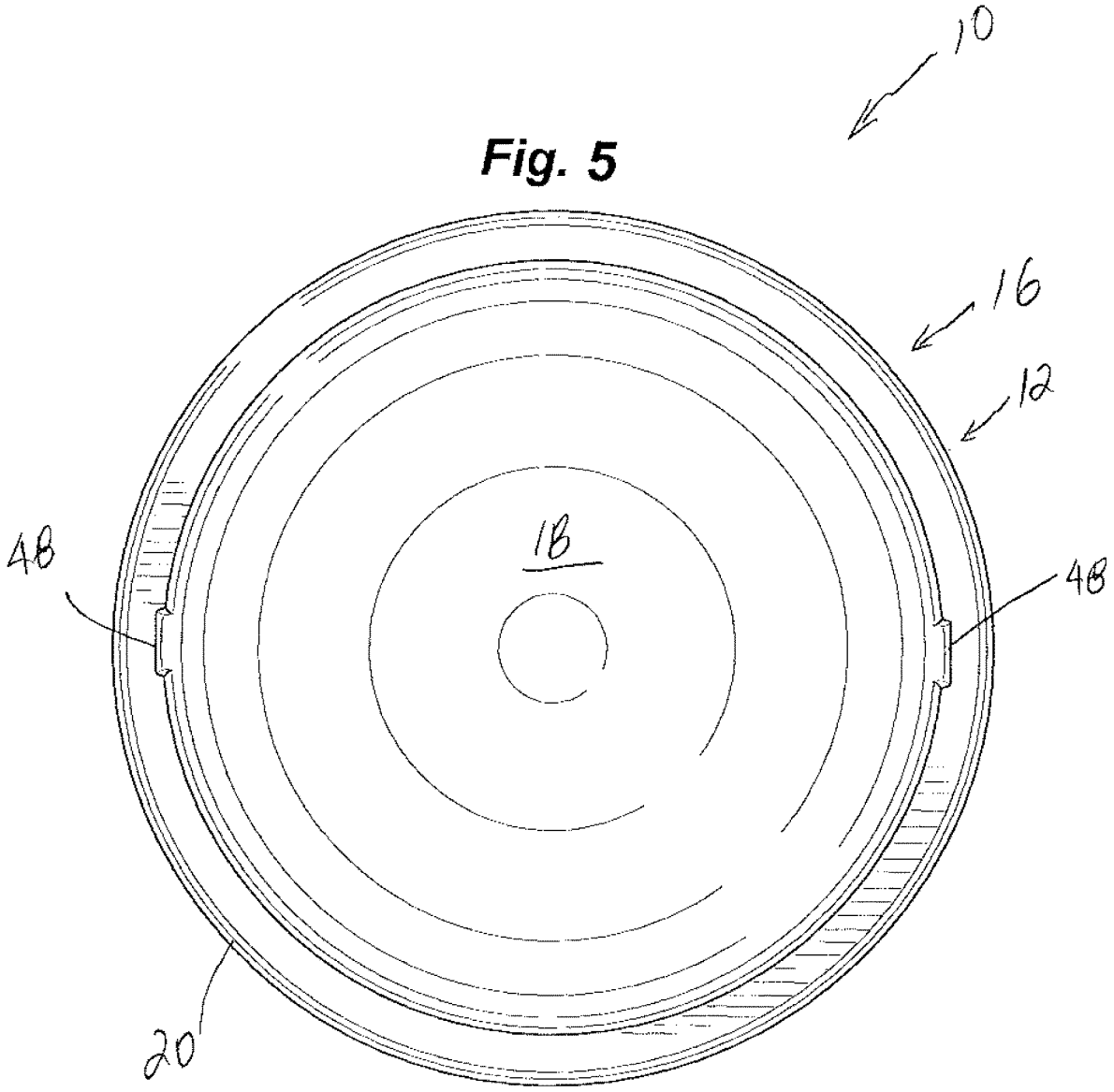
FIG. 5 is a top view of the seating system of FIG. 1.

FIGS. 1 and 2, respectively, are top and bottom perspective views of a non-limiting exemplary embodiment of a seating system 10. FIGS. 3 and 4 are orthogonal side views of the seating system 10, and FIGS. 5 and 6, respectively, are top and bottom views of the seating system 10. In a non-limiting exemplary embodiment, the seating system 10 includes a pedestal 12 and a reversible base 14.

Figure 7:
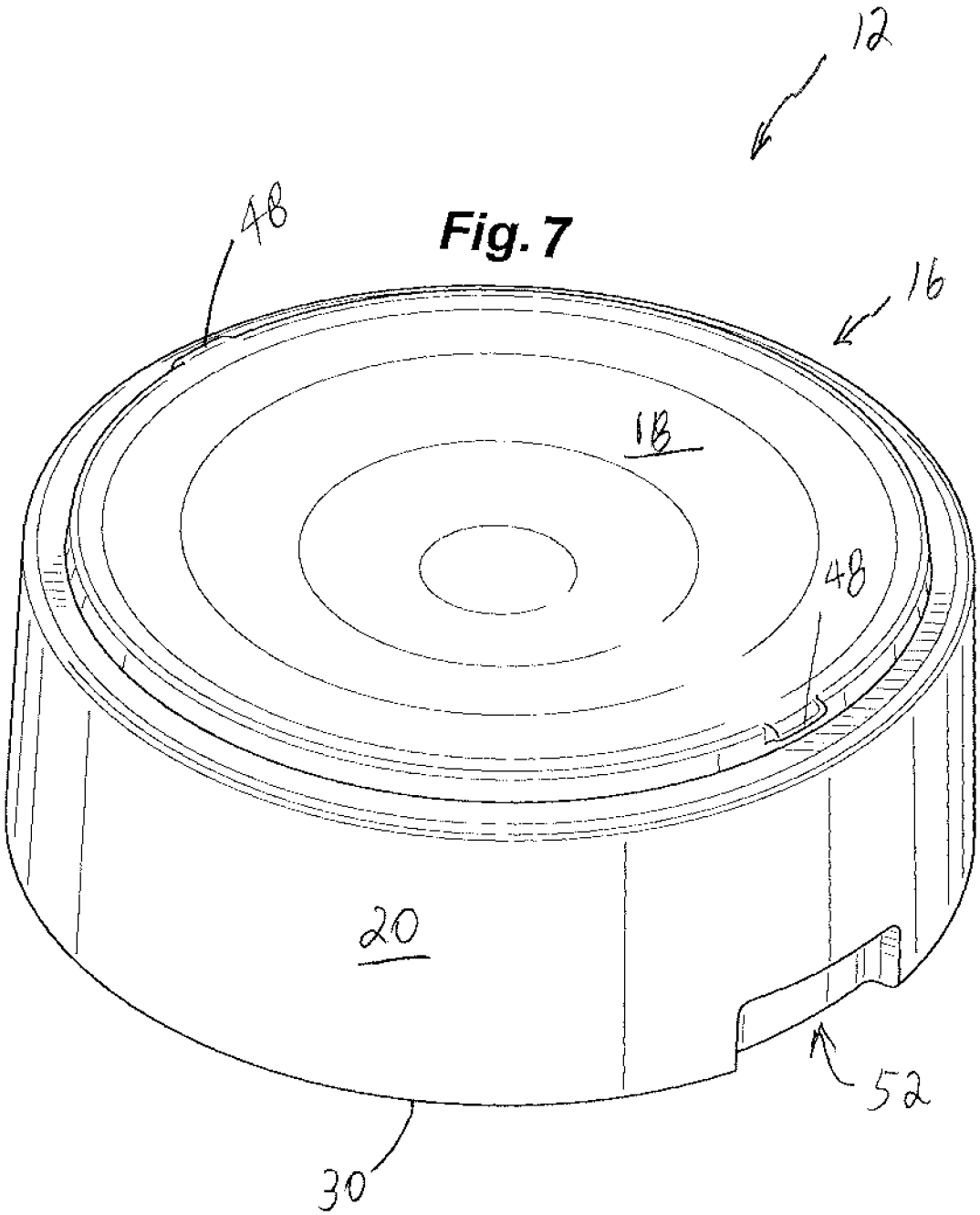
FIG. 7 is a top perspective view of a non-limiting exemplary embodiment of a pedestal for the seating system of FIG. 1.
Figure 8:
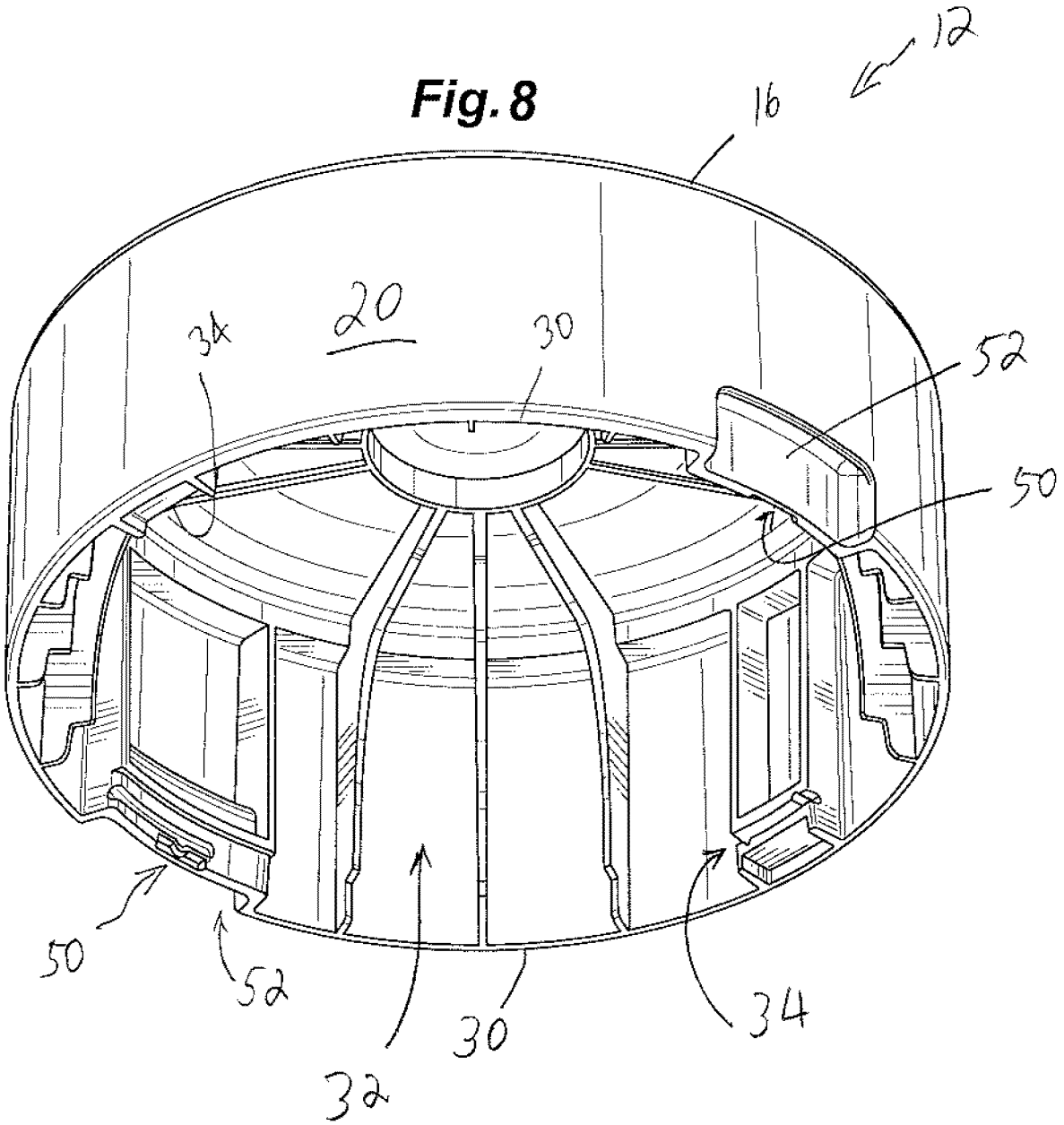
FIG. 8 is a bottom perspective view of the pedestal of FIG. 7.
Figure 9:
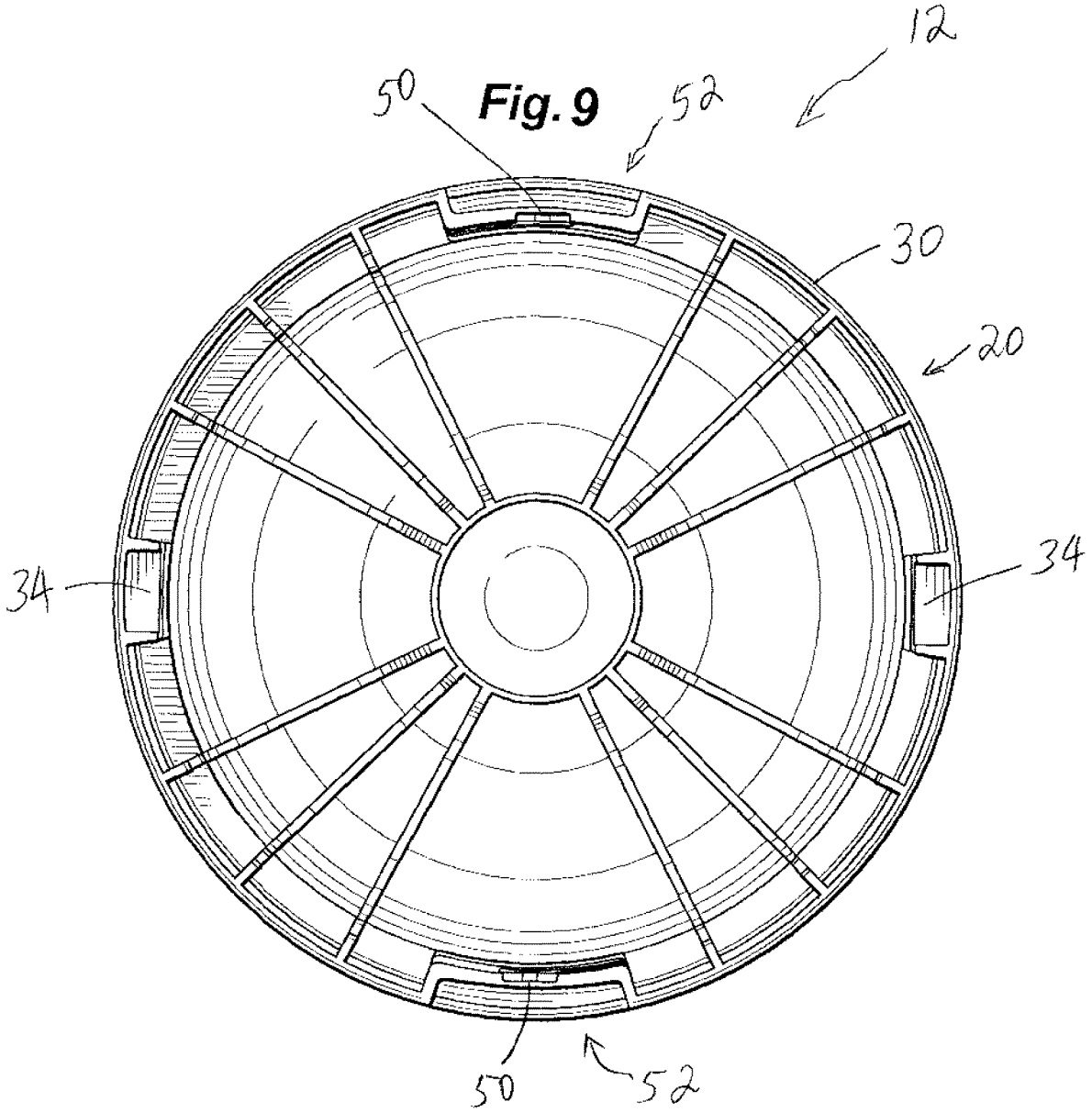
FIG. 9 is a bottom view of the pedestal of FIG. 7.

FIGS. 7 and 8, respectively, are top and bottom perspective views of a non-limiting exemplary embodiment of the pedestal 12, and FIG. 9 is a bottom view of the pedestal 12. In some embodiments, the pedestal 12 includes a top 16 having an outer surface 18, and a perimetrical wall 20 extending away from the top 16.

Figure 10:
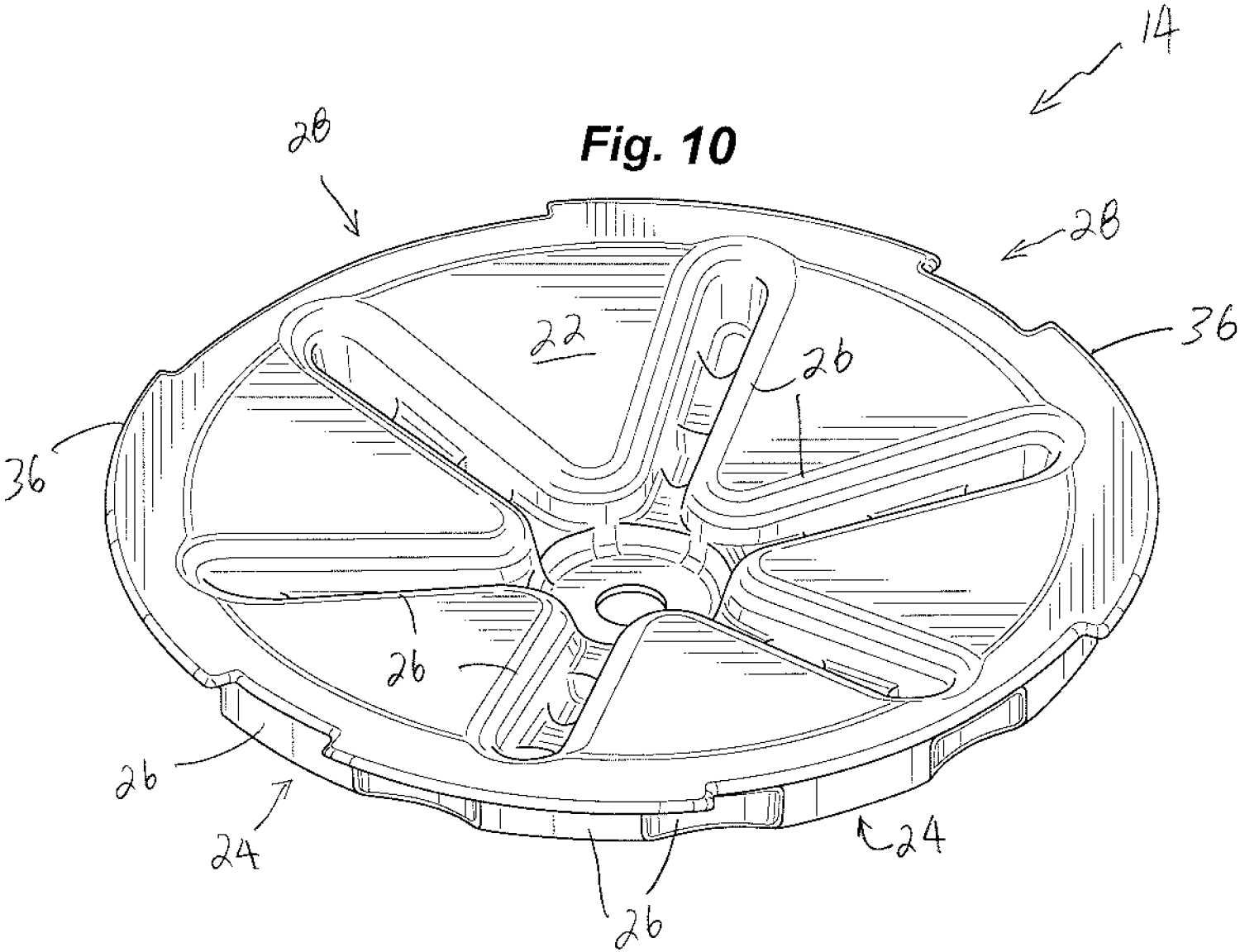
FIG. 10 is a top perspective view of a non-limiting exemplary embodiment of a reversible base for the seating system of FIG. 1.
Figure 11:
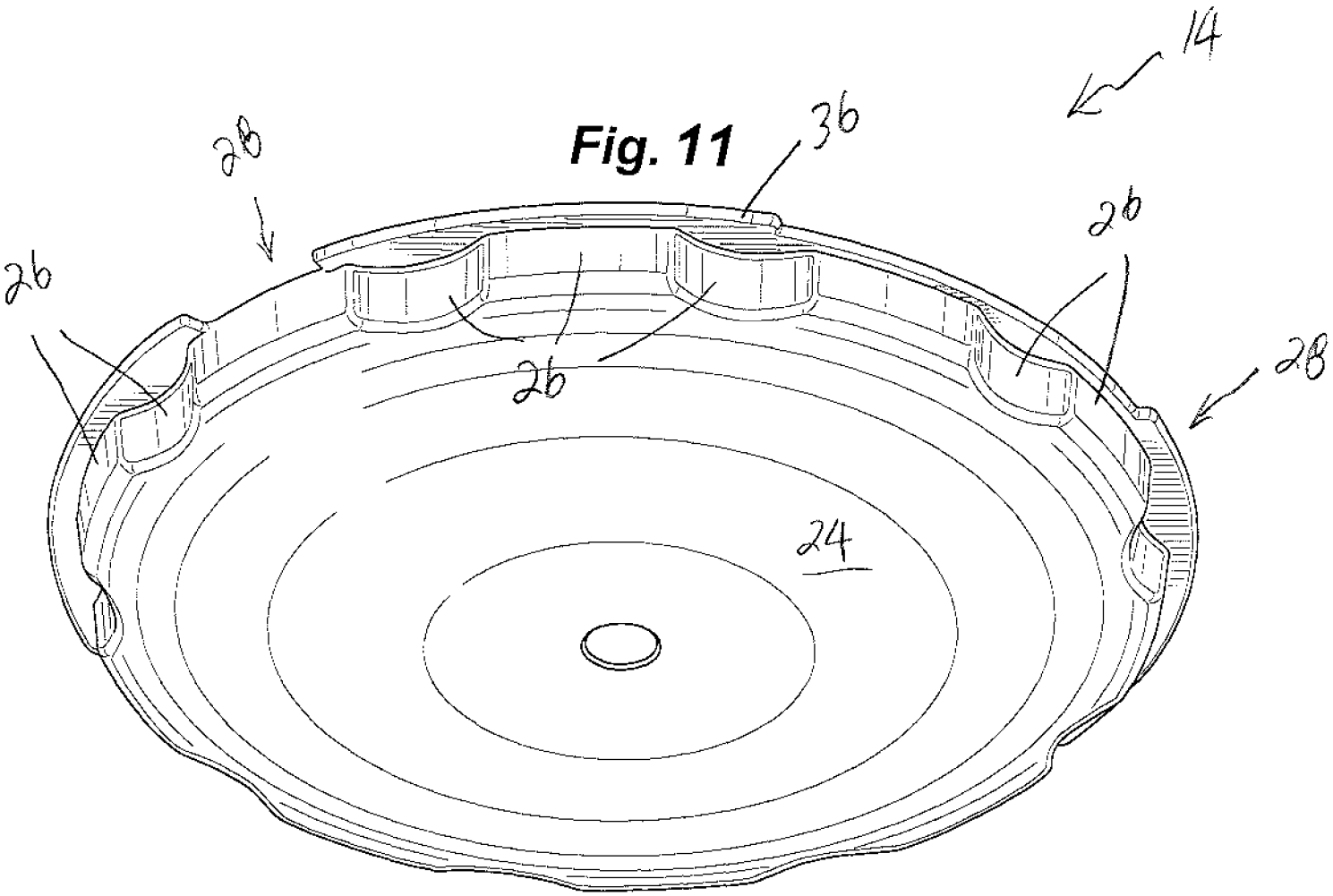
FIG. 11 is a bottom perspective view of the reversible base of FIG. 10.
Figure 12:
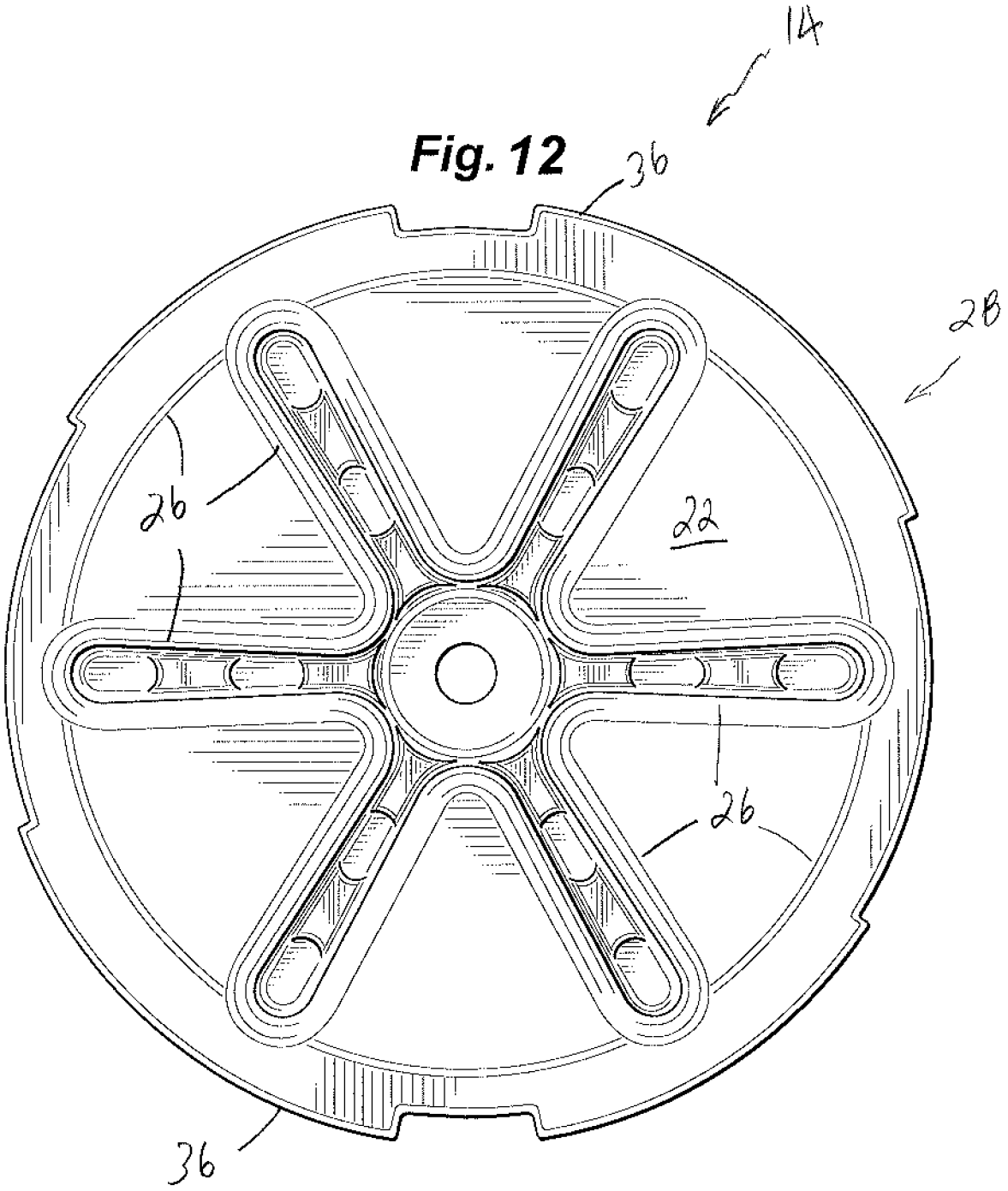
FIG. 12 is a top view of the reversible base of FIG. 10.
Figure 13:
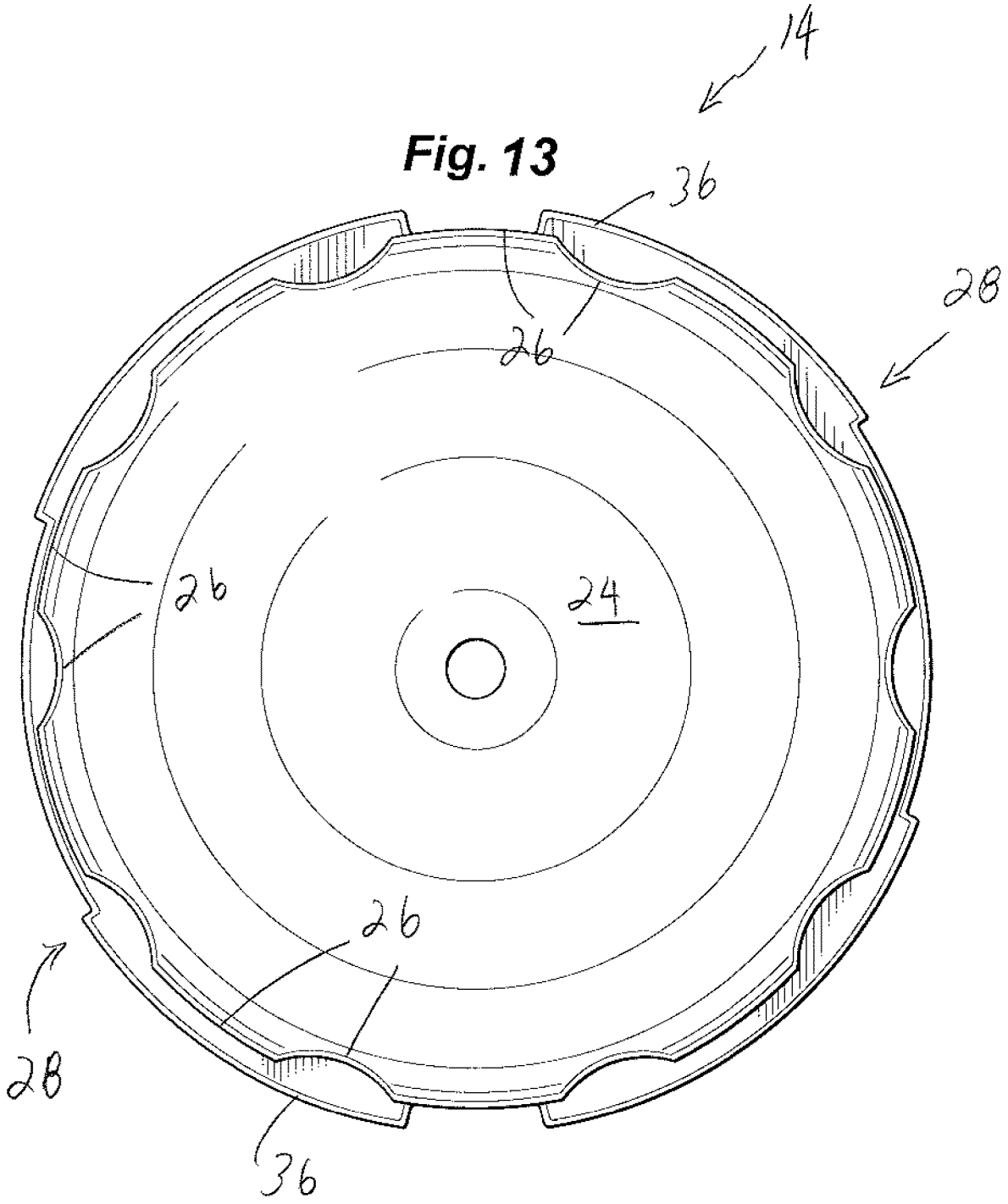
FIG. 13 is a bottom view of the reversible base of FIG. 10.

FIGS. 10 and 11, respectively, are top and bottom perspective views of a non-limiting exemplary embodiment of the reversible base 14, and FIGS. 12 and 13, respectively, are top and bottom views of the reversible base 14. In some embodiments, the reversible base 14 includes spaced apart inner and outer surfaces 22 and 24, respectively, and a wall 26 extending between the spaced apart inner and outer surfaces 22 and 24. In certain embodiments, the wall 26 is configured as a structural support wall. In some embodiments, the reversible base 14 includes a perimetrical ledge 28 extending outwardly from the inner surface 22.

In a non-limiting exemplary embodiment, the system 10 includes a first locking mechanism configured for removably securing (or coupling) the pedestal 12 and the reversible base 14 to each other. In particular, the first locking mechanism is configured for removably securing (or coupling) a bottom 30 of the perimetrical wall 20 and the ledge 28 of the reversible base 14 to each other. In some embodiments, the bottom 30 and the ledge 28, i.e., the pedestal 12 and the reversible base 14, are removably secured (or coupled) to each other with the outer surface 24 of the reversible base 14 oriented, i.e., facing, outwardly and away from the pedestal 12. In certain embodiments, the bottom 30 and the ledge 28 are removably secured (or coupled) to each other with the outer surface 24 of the reversible base 14 oriented, i.e., facing, inwardly into a hollow 32 of the pedestal 12.

In a non-limiting exemplary embodiment, the first locking mechanism includes complementary elements 34 and 36, respectively, disposed along the bottom 30 and the ledge 28. In some embodiments, the first locking mechanism is configured for removably securing the pedestal 12 and the reversible base 14 to each other when the outer surface 24 is oriented outwardly and away from the pedestal 12 and also when the outer surface 24 is oriented inwardly into the hollow 32 of the pedestal.

In certain embodiments, the complementary elements 34 and 36 of the first locking mechanism are configured for slidable engagement. For example, as perhaps best illustrated in FIGS. 8 and 10, the elements 34 and 36, respectively, are complementary slots (or channels, grooves) and tabs wherein the first locking mechanism is activated by engaging the slots 34 and tabs 36 with each other. In use, the ends of the slots 34 and the ends of the tabs 36 are aligned, for example positioned proximate each other, and the pedestal 12 and the reversible base 14 rotated whereby the tabs 36 slide into the slots 34. It will be appreciated that after aligning the complementary elements 34 and 36, either both the pedestal 12 and the reversible base 14 are rotated in opposing directions or only one of the pedestal 12 and the reversible base 14 is rotated relative to the other.

In some embodiments, the first locking mechanism additionally or in the alternative includes one or more detents or similar mechanisms configured for preventing or minimizing accidental separation of the pedestal 12 and the reversible base 14 after they have been removably secured to each other. In certain embodiments, the slot 34 is open at both ends, and the tab 36 is slid into the channel of the slot 34 through either one of the two open ends. In some embodiments, one of the slot 34 and tab 36 has a detent and the other has a complementary element or configuration whereby the tab 36 can be "locked" or "held in place" within the channel of the slot 34. In certain embodiments, the slot 34 is open at one end through which the tab 36 enters the channel, and the opposite end of the slot 34 is closed for preventing the tab 36 from exiting or disengaging from the slot 34. In some embodiments, the opposite end has a reduced width less than the thickness of the tab 36.

In certain embodiments, the first locking mechanism is configured as one or more tabbed connectors. Consequently, the first locking mechanism may be engaged by simply placing the ledge 28 proximate the bottom 30, aligning the complementary elements of each tabbed connectors, and displacing either the pedestal 12 and the reversible base 14 towards each other or one towards the other. In certain embodiments, the first locking mechanism may include one or more fasteners configured for removably securing the pedestal 12 and the reversible base 14 to each other. Additional or alternative embodiments or enhancements of locking mechanisms configured for removably securing the pedestal 12 and the reversible base 14 to each other are considered as being within the metes and bounds of the instant disclosure.

In a non-limiting exemplary embodiment, the outer surface 24 of the reversible base 14 is convex. Consequently, when the pedestal 12 and the reversible base 14 are removably secured to each other with the outer surface 24 oriented outwardly and away from the pedestal 12, the seating system 10 will have a convex base or bottom. When the pedestal 12 and the reversible base 14 are removably secured to each other with the outer surface 24 oriented inwardly into the hollow 32 of the pedestal 12, the seating system 10 will have a planar or essentially flat base or bottom. As such, the pedestal 12 is configured for stowing or storing the reversible base 14, for example when not in "use".

Figure 6:
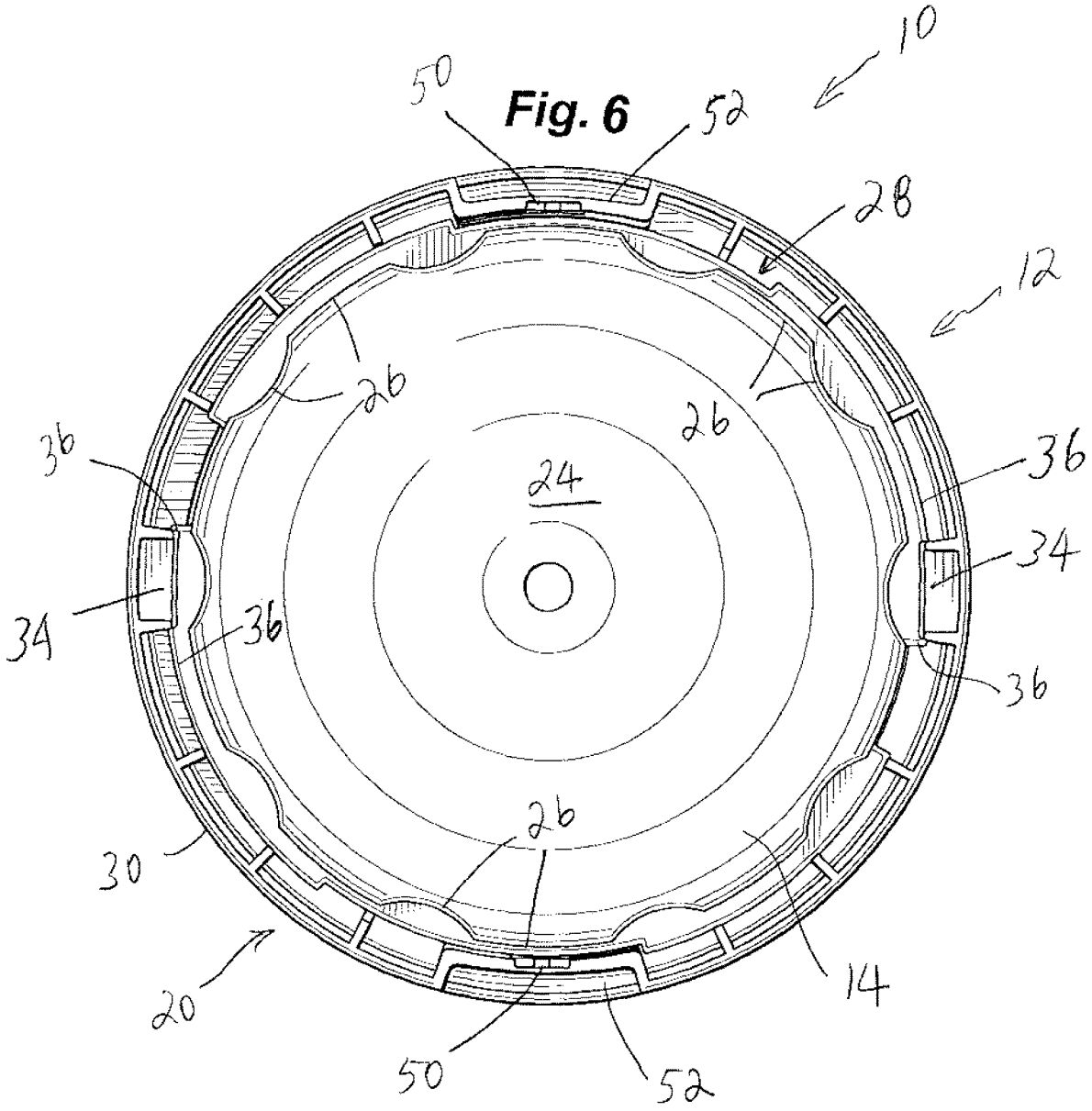
FIG. 6 is a bottom view of the seating system of FIG. 1.

In a non-limiting exemplary embodiment, when the pedestal 12 and the reversible base 14 are removably secured to each other, the outermost edge along the bottom 30 of the perimetrical wall 20 and the portion of the wall 26 along the outer boundary or perimeter of the reversible base 14 are spaced-apart from each other. With reference to FIGS. 3, 4 and 6, the reference numeral 38 illustrates an exemplary distance by which the outermost edge along the bottom 30 and the portion of the wall 26 along the outer boundary or perimeter of the reversible base 14 are spaced-apart from each other. In some embodiments, the distance 38 is configured as a "stop" which inhibits the seating system 10 from tipping over when a user "leans" the seating system 10 in which the convex outer surface 24 of the reversible base 14 is oriented outwardly and away from the pedestal 12. In certain embodiments, the convex outer surface 24 of the reversible base 14 is configured to provide an arc or displacement of approximately 10 degrees between the bottom 30 of the perimetrical wall 20 and a substantially planar surface on which the seating system 10 is placed.

In a non-limiting exemplary embodiment, the outer surface 18 of the pedestal 12 is configured for seating. In some embodiments, the outer surface 18 is substantially planar. In certain embodiments, the outer surface 18 is at least partially concave. In some embodiments, the outer surface 18 is cushioned, i.e., the outer surface 18 includes or is configured as a cushion.

Figure 14:
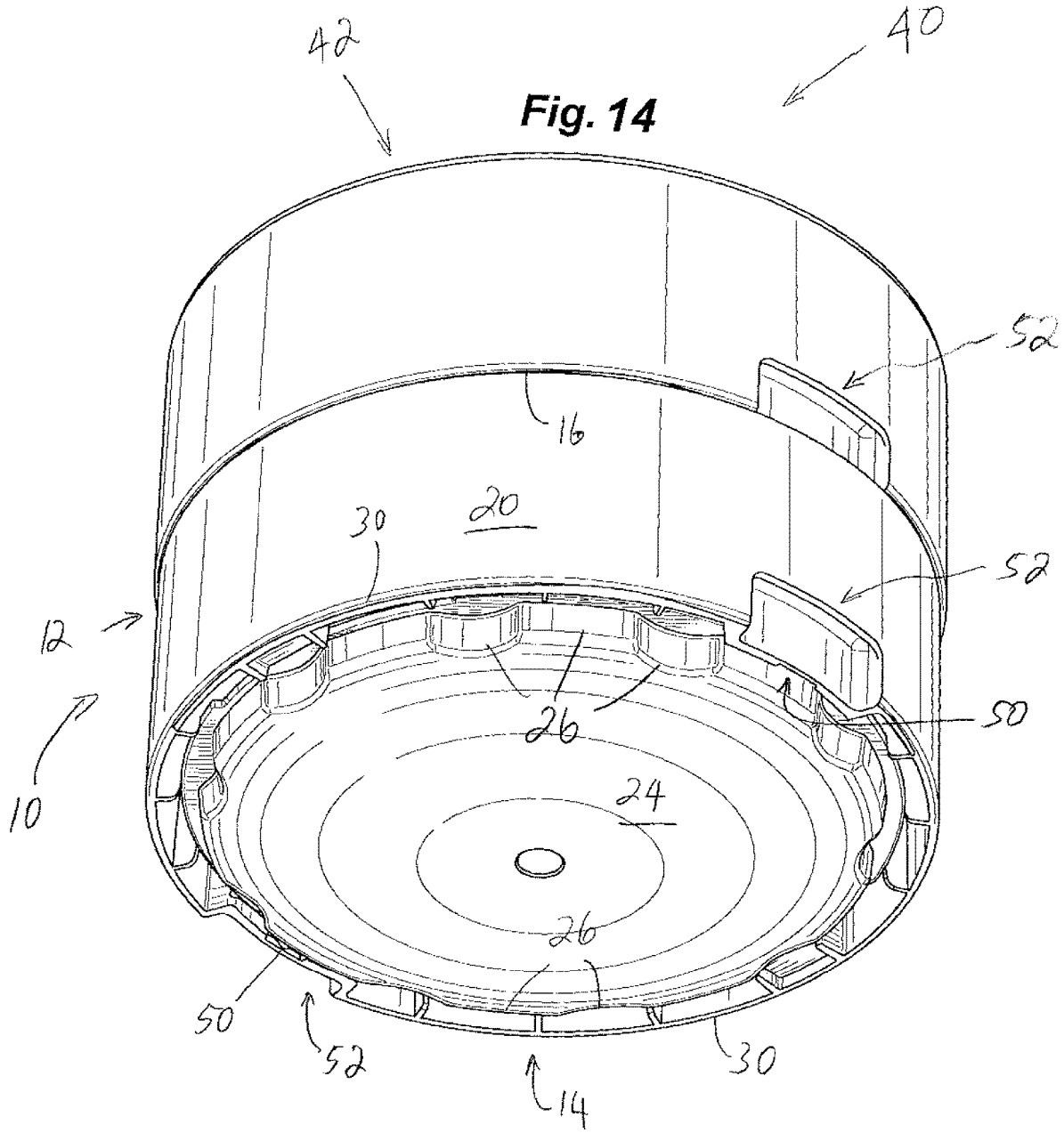
FIG. 14 is a bottom perspective view of a non-limiting exemplary embodiment of a two pedestal seating system wherein the seating system of FIG. 1 is at the bottom.
Figure 15:
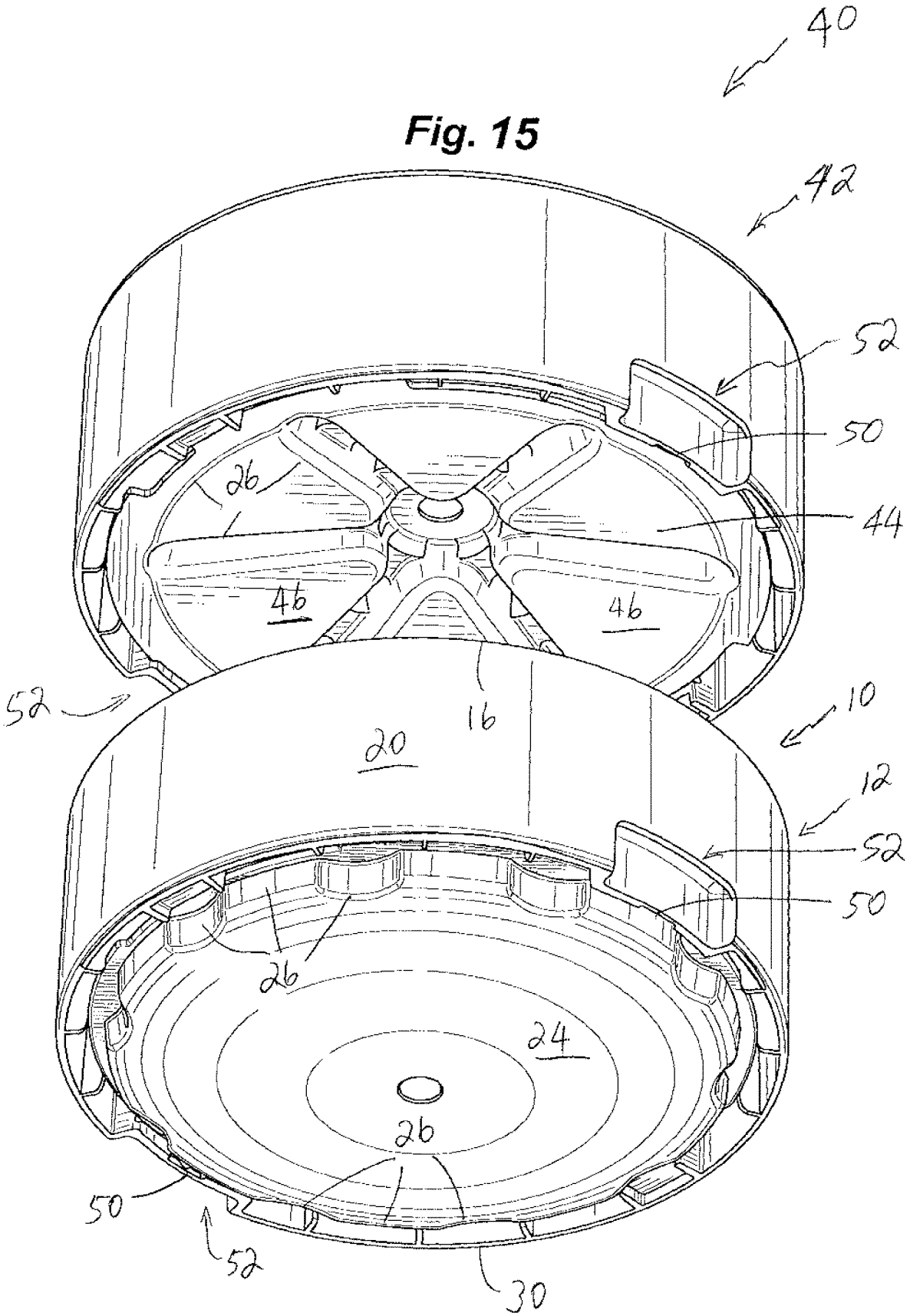
FIG. 15 is a bottom perspective view of the seating system of FIG. 14 in a disassembled state.
Figure 16:
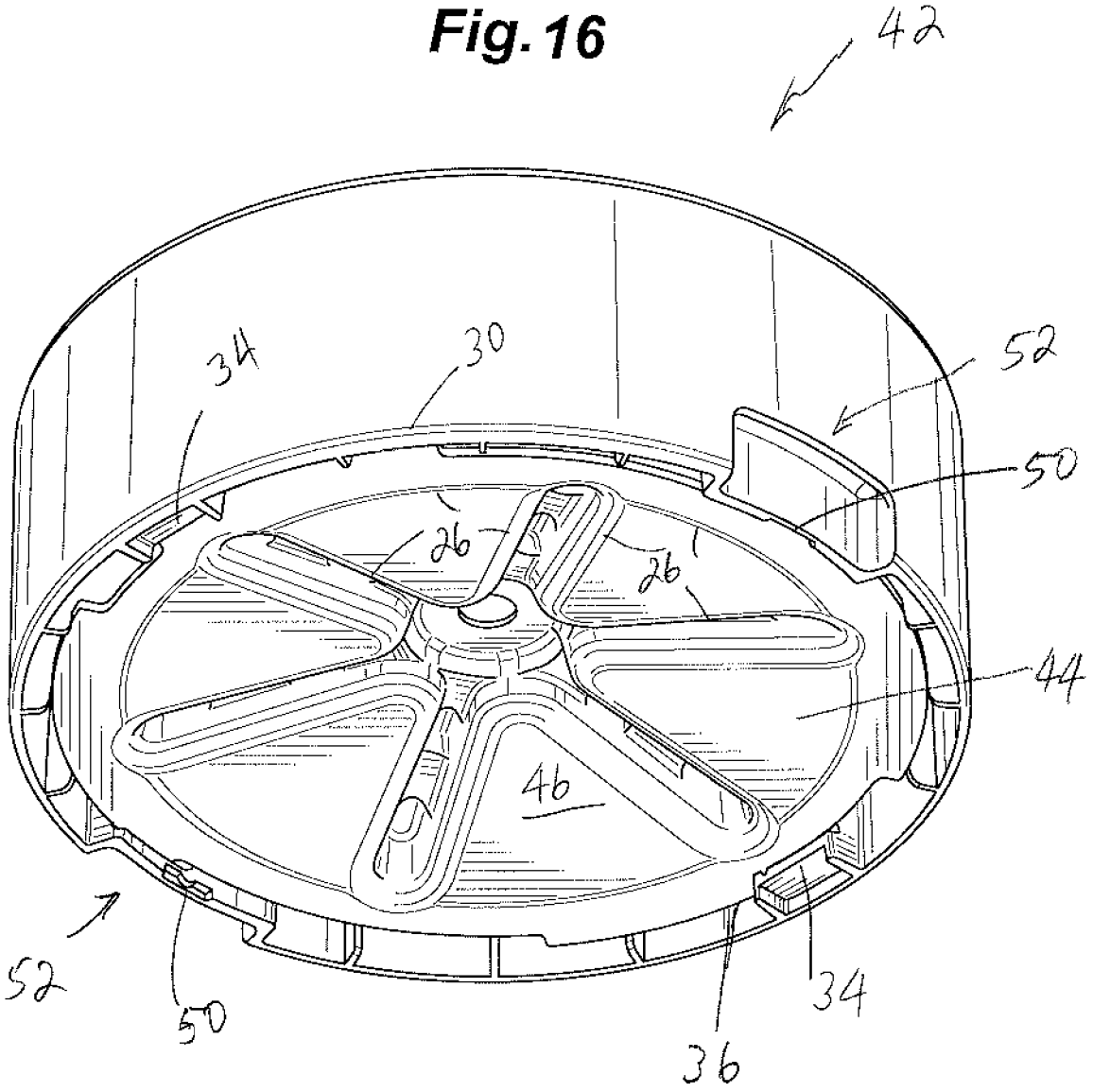
FIG. 16 is a bottom perspective view of the upper pedestal of the two pedestal seating system of FIGS. 14 and 15.

FIG. 14 illustrates a non-limiting exemplary embodiment of a seating system 40 having two pedestals removably secured (or coupled) to each other. In the illustrated embodiment, an additional, or second, seating system is removably secured (or coupled) to the pedestal 12, i.e., to the seating system 10. FIG. 15 illustrates the seating system 40 with the second seating system de-coupled, or separated, from the pedestal 12, i.e., the seating system 10. FIG. 16 illustrates the de-coupled second seating system.

In the illustrated embodiment, the seating system 40 includes two pedestals, viz., first pedestal 12 and second pedestal 42, and two reversible bases, viz., first reversible base 14 and second reversible base 44. In some embodiments, the second pedestal 42 is substantially identical to the first pedestal 12, and the second reversible base 44 is substantially identical to the first reversible base 14. Consequently, a second locking mechanism for removably securing (or coupling) the second pedestal 42 and the second reversible base 44 to each other is substantially identical to the first locking mechanism. In other words, all locking mechanisms for removably securing (or coupling) a pedestal and a reversible base to each other, regardless of being labeled as the first or the second locking mechanism, are substantially identical. As such, it will be apparent that the substantially identical first and second pedestals 12 and 42 are interchangeable, and the substantially identical first and second reversible bases 14 and 44 are also interchangeable. In other words, any one of the substantially identical first and second pedestals 12 and 42 and any one of the substantially identical first and second reversible bases 14 and 44 can be removably, and interchangeably, secured (or coupled) to each other. As such, a seating system defined at least in part by removably securing (or coupling) the second pedestal 42 and the second reversible base 44 to each other is substantially identical to the seating system 10 which is defined at least in part by removably securing (or coupling) the first pedestal 12 and the first reversible base 14 to each other.

FIG. 14 illustrates the pedestal 12 and the reversible base 14 removably secured (or coupled) to each other with the outer surface 24 of the reversible base 14 oriented outwardly and away from the pedestal 12. FIG. 15 illustrates the pedestal 42 and the reversible base 44 removably secured (or coupled) to each other with the inner surface 46 of the reversible base 44 oriented outwardly and away from the pedestal 42. That is, the outer surface (not shown) of the reversible base 44 is oriented inwardly into the hollow of the pedestal 42. As such, the reversible base 44 can be considered as being stored or stowed within the pedestal 42.

Referring back to the embodiment of the pedestal 12 illustrated in FIGS. 1-9, a non-limiting exemplary embodiment of the pedestal 12 includes complementary elements 48 and 50, respectively, disposed on the top 16 of the pedestal 12 and the bottom 30 of the perimetrical wall 20 of the pedestal 12. Accordingly, each substantially identical pedestal, e.g., pedestals 12 and 42, will have substantially identical complementary elements, e.g., complementary elements 48 and 50, disposed on their respective tops and bottoms. As described with reference to FIG. 15, a third locking mechanism, defined at least in part by the complementary elements 48 of a first pedestal (e.g., pedestal 12) and 50 of a second pedestal (e.g., pedestal 42), is configured for removably securing (or coupling) the first pedestal (e.g., pedestal 12) and the second pedestal (e.g., pedestal 42) to each other and minimizing the potential of accidental separation. In general, the third locking mechanism is configured for removably securing (or coupling) two pedestals to each other and minimizing the potential of accidental separation.

In certain embodiments, the complementary elements 48 and 50 of the third locking mechanism are configured for slidable engagement. For example, as perhaps best illustrated in FIGS. 4, 7 and 8, the elements 48 and 50, respectively, are complementary tabs and slots (or channels, grooves) wherein the third locking mechanism is activated by coupling or engaging the tabs 48 and the slots 50 with each other. In use, the ends of the tabs 48 and the ends of the slots 50 are aligned, for example positioned proximate each other, and the pedestals 12 and 42 are rotated whereby the tabs 48 slide into the slots 50. It will be appreciated that after aligning the complementary elements 48 and 50, either both pedestals 12 and 42 are rotated in opposing directions or only one of the pedestals 12 and 42 is rotated relative to the other.

In some embodiments, the third locking mechanism additionally or in the alternative includes one or more detents or similar mechanisms configured for preventing or minimizing accidental separation of the pedestals 12 and 42 after they have been removably secured to each other. In certain embodiments, the slot 50 is open at both ends, and the tab 48 is slid into the channel of the slot 50 through either one of the two open ends. In some embodiments, one of the tab 48 and the slot 50 has a detent and the other has a complementary element or configuration whereby the tab 48 can be "locked" or "held in place" within the channel of the slot 50. In certain embodiments, the slot 50 is open at one end through which the tab 48 enters the channel, and the opposite end of the slot 50 is closed for preventing the tab 48 from exiting or disengaging from the slot 50. In some embodiments, the opposite end has a reduced width less than the thickness of the tab 48.

In certain embodiments, the third locking mechanism is configured as one or more tabbed connectors. Consequently, the third locking mechanism may be activated or engaged for removably securing the pedestals 12 and 42 to each other by simply aligning the complementary elements of each tabbed connectors, and displacing the pedestals 12 and 42 towards each other or one towards the other. In certain embodiments, the third locking mechanism may include one or more fasteners configured for removably securing the pedestals 12 and 42 to each other. Additional or alternative embodiments or enhancements of locking mechanisms configured for removably securing the pedestals 12 and 42 to each other are considered as being within the metes and bounds of the instant disclosure.

It will be appreciated that while FIG. 14 illustrates the pedestal 42 and the reversible base 44 removably secured to each other with the outer surface of the reversible base 44 oriented inwardly into the hollow of the pedestal 42, this is not a requirement for removably securing the pedestals 12 and 42 to each other. For instance, the pedestal 42 may not include the reversible base 44 when the pedestals 12 and 42 are removably secured to each other. However, in order to ensure that the reversible base 44 does not get misplaced or lost, it is probably desirable to removably secure the pedestal 42 and the removable base 44 to each other, as illustrated, prior to removably securing the pedestals 12 and 42 to each other.

It will be further appreciated that while FIGS. 14 and 15 illustrate the pedestal 12 and the reversible base 14 removably secured to each other with the outer surface 24 of the reversible base 14 oriented outwardly and away from the pedestal 12, this is not a requirement. For instance, in some embodiments, the pedestal 12 and the reversible base 14 may be removably secured to each other with the outer surface 24 of the reversible base 14 oriented inwardly into the hollow of the pedestal 12.

It will be additionally appreciated that while FIGS. 14 and 15 illustrate two pedestals 12 and 42, this should not be construed as limiting. For instance, some embodiments of the seating system may include three or more removably secured pedestals. For example, a non-limiting embodiment of a seating system may include three pedestal, a bottom, a middle and a top pedestal. In some embodiments, the middle and the top pedestals are removably secured to each other much like the pedestals 12 and 42. Likewise, the middle and the bottom pedestals are also removably secured to each other much like the pedestals 12 and 42 (or like the top and the middle pedestals). In certain embodiments of the seating system with three pedestals, as described, one or more reversible bases may be provided. However, this is not a requirement nor a limitation. For instance, the seating system may not include any reversible bases. In some embodiments, only one reversible base may be provided for removable securement with the bottom pedestal. The one reversible base and the bottom pedestal may be removably secured to each other with the outer surface of the reversible base oriented either outwardly and away from the bottom pedestal or inwardly into the hollow of the bottom pedestal. If one additional reversible base is provided, it would be preferable to stow or store the additional reversible base within the middle or the top pedestal by removably securing the reversible base and either one of the pedestals to each other to circumvent the possibility of misplacing the reversible base. Of course if one more, i.e., a third, reversible base is provided, it can be also stowed or stored by removably securing the remaining pedestal, i.e., the pedestal without a reversible base, and the third reversible base to each other. It should be apparent that in order to provide a seating system with three pedestals, the other surface of any reversible bases stowed or stored within the middle and/or the top pedestal must be oriented inwardly into the hollow of the pedestal.

It will be further appreciated that in non-limiting exemplary embodiments of seating systems with, for example three pedestals, two or more separate seating systems can be assembled. For instance, such a seating system can be configured to provide two individual or separate seating systems having one seating system similar to the seating system 10 and another seating system similar to the seating system 40. Or, the seating system can be configured to provide three individual or separate seating systems, each similar to the seating system 10.

In a non-limiting exemplary embodiment, the perimetrical walls of the pedestals 12 and 42 include one or more set-backs or depressions 52 configured for lifting the pedestals individually and for lifting the seating system 10 or 40 using a user's fingers. In some embodiments, the one or more set-backs 52 are used for removably securing (or coupling) two pedestals to each other. In certain embodiments, the one or more set-backs 52 are used for removably securing (or coupling) a pedestal and a reversible base to each other.

It will be appreciated that while the pedestals 12 and 42 are illustrated as cylindrical, this is not a requirement. Pedestals having any geometrical shape are contemplated and are therefore considered as being within the metes and bounds of the instant disclosure. In some embodiments, the non-cylindrical pedestals have an opening in the bottom configured for accommodating the reversible bases 14 and 54. In certain embodiments, the non-cylindrical pedestals have an opening in the bottom configured for accommodating a reversible base having a geometry different from that of the reversible bases 14 and 54. Reversible bases having alternative shapes are contemplated and are therefore considered as being within the metes and bounds of the instant disclosure.

In addition thereto, a method of assembling one or more seating systems 10 and/or 40 will be apparent in light of the description of the components, i.e., the pedestals 12 and 42, the reversible bases 14 and 44, and the various locking mechanisms.

Briefly, a method of assembling the seating system 10 includes removably securing a pedestal 12 or 42 and a reversible base 14 or 44 to each other at the bottom of the perimetrical wall of the pedestal, e.g., the bottom 30 of the perimetrical wall 20 of the pedestal 12. The pedestal and the reversible base are removably secured to each other with the outer surface of the reversible base oriented either outwardly and away from the pedestal or inwardly into the hollow of the pedestal. For example, the pedestal 12 and the reversible base 14 are removably secured to each other with the outer surface 24 of the reversible base 14 oriented either outwardly and away from the pedestal 12 or inwardly into the hollow 32 of the pedestal 12. As such, a plurality of pedestals and a plurality of reversible bases can be removably secured to each other with the respective outer surface of each reversible base oriented either outwardly and away from the pedestal to which it is removably secured or inwardly into the hollow of the pedestal to which it is removably secured. The pedestal with the outer surface of the reversible base oriented inwardly into the hollow of the pedestal can be used for seating and/or can be removably secured to another pedestal to provide a stacked seating system.

A non-limiting exemplary embodiment of a method of assembling a seating system with multiple stacked pedestals, e.g., the seating system 40, includes removably securing two pedestals to each other. The pedestals are removably secured to each other either before or after removably securing the bottom most pedestal and a reversible base to each other. The bottom most pedestal and the reversible base are removably secured to each other with the outer surface of the reversible base oriented either outwardly and away from the pedestal or inwardly into the hollow of the pedestal. It will be apparent that an additional pedestal can be added, for example for increasing the height of the seating system, by removably securing the top pedestal of a two pedestal seating system and the additional pedestal to each other. Each pedestal other than the bottom pedestal and a reversible base can be removably secured to each other with the outer surface of the reversible base oriented inwardly into the hollow of the pedestal. Obviously, this step will need to be performed before removably securing the pedestals to each other. The bottom pedestal and a reversible base can be removably secured to each other with the outer surface of the reversible base oriented either outwardly and away from the pedestal or inwardly into the hollow of the pedestal.

It should be apparent that the seating system will be capable of multi-directional motion when the base or bottom of the seating system has a convex surface. Accordingly, in non-limiting exemplary embodiments, the seating systems 10 and 40 will provide multi-directional motion when the single or the bottom pedestal and the reversible base are removably secured to each other with a convex outer surface of the reversible base oriented outwardly and away from the pedestal.

In view thereof, modified and/or alternate configurations of the embodiments described herein may become apparent or obvious. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A stacked pedestal seating system, comprising:

at least two pedestals removably attached and stacked with respect to one another in a manner so as to be usable as a seating system formed from the stacked pedestals;

an uppermost pedestal of the stacked pedestals including a top surface configured for seating;

a lowermost pedestal of the stacked pedestals; and a reversible base having a convex surface removably secured to the lowermost pedestal;

wherein the stacked pedestal seating system is capable of multi-directional motion when the base is secured to the lowermost pedestal with the convex surface facing outwardly away from the lowermost pedestal; and wherein the stacked pedestal seating system has an essentially flat bottom when the reversible base is secured to the lowermost pedestal with the convex surface not facing outwardly away from the lowermost pedestal.

2. The seating system of claim 1, further including a removable base securable to the uppermost pedestal.

3. The seating system of claim 2, wherein the removable base of the uppermost pedestal is reversible.

4. The seating system of claim 3, wherein the lowermost pedestal further includes a locking system for securing the reversible base to the lowermost pedestal.

5. The seating system of claim 4, wherein the locking system can secure the reversible base to the lowermost pedestal with the convex surface facing inwardly.

6. The seating system of claim 5, wherein the locking system can secure the reversible base to the lowermost pedestal with the convex surface facing outwardly away from the lowermost pedestal.

7. The seating system of claim 1, wherein each pedestal includes a locking system for securing the removable attachment of the at least two pedestals with respect to one another.

8. The seating system of claim 1, wherein the top surface of the uppermost pedestal includes a cushion.

9. The seating system of claim 1, wherein the convex surface of the reversible base faces inwardly into the lowermost pedestal when the base is positioned so as not to face outwardly away from the lowermost pedestal.

10. A seating system, comprising:

a pedestal forming a body of the seating system and including a top surface configured for seating; and a reversible base having a convex surface, the base being removably securable to the pedestal;

wherein the base may be secured to the pedestal with the convex surface facing outwardly away from the pedestal and may be secured to the pedestal with the convex surface facing inwardly towards the pedestal;

the seating system being capable of multi-directional motion when the base is secured to the pedestal and positioned with the convex surface facing outwardly away from the pedestal; and the seating system having an essentially flat bottom when the base is secured to the pedestal and positioned so that the convex surface faces inwardly towards the pedestal.

11. The seating system of claim 10, wherein the pedestal further includes a locking system for securing the base to the pedestal.

12. The seating system of claim 11, wherein the locking system can secure the base to the pedestal with the convex surface facing inwardly.

13. The seating system of claim 11, wherein the locking system can secure the base to the pedestal with the convex surface facing outwardly away from the pedestal.

14. The seating system of claim 11, wherein the top surface of the pedestal includes a cushion.

15. A seating system, comprising:

a pedestal forming a body of the seating system and including a top surface configured for seating and further having a removable base having a convex surface, and further having a locking system for securing the removable base to the pedestal;

the seating system being capable of multi-directional motion when the removable base is secured to the pedestal through the locking system with the convex surface of the removable base facing outwardly away from the pedestal; and the seating system having an essentially flat bottom when the removable base is secured to the pedestal through the locking system with the convex surface of the removable base facing inwardly into the pedestal.

16. The seating system of claim 15, wherein the removable base of the pedestal is reversible.

17. The seating system of claim 16, wherein the top surface of the uppermost pedestal includes a cushion.

* * * * *